US009127633B2

(12) United States Patent
Canepa-Anson et al.

(10) Patent No.: US 9,127,633 B2
(45) Date of Patent: Sep. 8, 2015

(54) ACTUATOR ARRANGEMENT

(75) Inventors: Thomas W. Canepa-Anson, Richmond (GB); Anthony Thomas Harcombe, Richmond (GB); Bashir Khan, Cheltenham (GB); Mark S. Graham, Westbury On Trym (GB); Mark S. Harper, Hagley (GB)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 1013 days.

(21) Appl. No.: 13/257,020

(22) PCT Filed: Mar. 18, 2010

(86) PCT No.: PCT/EP2010/053572

§ 371 (c)(1),
(2), (4) Date: Dec. 21, 2011

(87) PCT Pub. No.: WO2010/106149

PCT Pub. Date: Sep. 23, 2010

(65) Prior Publication Data

US 2012/0091233 A1 Apr. 19, 2012

(30) Foreign Application Priority Data

Mar. 19, 2009 (GB) ..... 0904645.9

(51) Int. Cl.
*F02D 7/00* (2006.01)
*F02M 63/00* (2006.01)

(52) U.S. Cl.
CPC ..... *F02M 63/0015* (2013.01); *F02M 63/0059* (2013.01); *Y10T 29/4902* (2015.01); *Y10T 29/49004* (2015.01)

(58) Field of Classification Search
CPC ..... F02M 63/0015; F02M 63/0059
USPC ..... 239/585.1–585.5, 5; 251/129.15, 251/129.21; 335/299
See application file for complete search history.

(56) References Cited

U.S. PATENT DOCUMENTS 5,263,647 A 11/1993 Cerny et al.
5,392,995 A * 2/1995 Wahba ..... 239/585.4
(Continued)

FOREIGN PATENT DOCUMENTS

CN 1283947 11/2006
DE 102005058317 6/2007
(Continued)

OTHER PUBLICATIONS

International Search Report dated Jul. 1, 2010.
(Continued)

*Primary Examiner* — Dinh Q Nguyen
(74) *Attorney, Agent, or Firm* — Thomas N. Twomey

(57) ABSTRACT

An actuator arrangement for an electromagnetically operated fuel injector includes a generally cylindrical actuator core having a longitudinal axis and defining an inner pole face of the actuator arrangement. The actuator core is formed of a bespoke magnetic material. A wire coil is disposed around the actuator core arranged to be connected to a power source to generate a magnetic field around the coil. A pole member is formed of a high strength material and defines an aperture for receiving the actuator core. The pole member defines an outer pole face of the actuator arrangement substantially co-planar with the inner pole face. An armature is movable in a direction parallel to the longitudinal axis in response to the magnetic field. The magnetic field passes into the armature in the region of the inner pole face and into the armature in the region of the outer pole face.

19 Claims, 7 Drawing Sheets

(56) References Cited

U.S. PATENT DOCUMENTS

| | | | | |
|---|---|---|---|---|
| 6,032,879 | A * | 3/2000 | Hamada et al. | 239/585.1 |
| 6,431,474 | B2 * | 8/2002 | Fochtman et al. | 239/585.4 |
| 6,609,698 | B1 | 8/2003 | Parsons et al. | |
| 6,932,284 | B2 * | 8/2005 | Cristiani et al. | 239/585.1 |
| 6,981,663 | B2 * | 1/2006 | Fukutomi | 239/585.5 |
| 2006/0022072 | A1 | 2/2006 | Ciampolini | |

FOREIGN PATENT DOCUMENTS

| | | |
|---|---|---|
| EP | 1619383 | 1/2006 |
| EP | 1693563 | 8/2006 |
| JP | 57-99265 | 6/1982 |
| JP | 60-240865 | 11/1985 |
| JP | 3-129769 | 12/1991 |
| JP | 2000-046224 A | 2/2000 |
| JP | 2004-014700 A | 1/2004 |
| JP | 2006-258139 | 9/2006 |
| JP | 2007-281124 | 10/2007 |
| JP | 2007-288129 | 11/2007 |

OTHER PUBLICATIONS

Letter regarding comments and China Office Action dated Dec. 26, 2012.

English Translation of Japan Office Action dated Jan. 25, 2013.

* cited by examiner

ACTUATOR ARRANGEMENT

FIELD OF INVENTION

The present invention relates to an actuator arrangement. In particular, the present invention relates to an improved actuator design for use in an electromagnetic fuel injector, an improved method of forming the actuator arrangement and an improved method of assembling an actuator arrangement in accordance with embodiments of the present invention.

BACKGROUND TO THE INVENTION

FIG. 1 shows a known fuel injector arrangement 1 in which a nozzle arrangement 3 is secured to a nozzle holder body 5 by means of a cap nut 7 that is generally U-shaped in cross section. The injector 1 is generally elongate in form and defines a longitudinal axis that runs the length of the injector.

The nozzle arrangement 3 comprises an elongated injection nozzle 9 having an injection region that extends through an aperture 11 in the lower part of the cap nut. The injection nozzle houses an injection needle 13 that is slidable within a bore 15 within the nozzle 13 so as to control fuel delivery though one or more nozzle outlets (not shown in FIG. 1) into a combustion volume (also not shown in FIG. 1).

The needle 13 is supplied with fuel under high pressure from a high pressure fuel inlet 17 and fuel pressure variations within a control volume 19 located on top of the needle 13 control, in use, the movement of the needle 13 to release fuel through the nozzle outlets.

A first distance piece 21 lies above and abuts up against the injection nozzle 9 and includes a through-drilling 23 that serves to convey pressurised fuel from a valve block 25 located adjacent the distance piece to the injection nozzle. The distance piece 21 also includes a blind bore 27 which receives a back end of the injection needle 13 such that the control chamber 19 is defined between the injection needle 13 and the upper end of the blind bore 27.

The valve block 25 is positioned intermediate the distance piece 21 and the nozzle holder body 5 and includes a high pressure drilling 29 that conveys fuel from the high pressure inlet 17 defined in the nozzle holder body to the drilling 23 in the distance piece. The valve block 25 also includes a valve arrangement comprising an elongate valve member 31 and a disc-shaped armature 33 which is acted upon by an actuator arrangement 35.

The actuator arrangement, generally indicated as feature 35 in FIG. 1, is provided within a recess 36 defined in a lower region of the nozzle holder body 5. The actuator arrangement, an electromagnetic solenoid, comprises a magnetic core member 37 and a coil or winding (not shown in FIG. 1) which are used to control the movement of a valve member 31, the position of which affects the pressure within the control volume 19. The valve member 31 is partially provided within a blind bore 39 provided in a lower portion of the actuator arrangement 35. A valve member spring 41 is located within the blind bore 39 and acts to bias the valve 31 away from the actuator arrangement 35.

An upper region of the nozzle holder body includes a lateral recess 43 which receives an electrical connector 45. A bore 47 extends from the recess 43 to the first recess 36 which houses the solenoid 35. An electrical supply lead extends through the bore 47 from the upper face of the solenoid and connects to the electrical connector 45 thereby supplying energy to the solenoid.

The nozzle holder body 5 further includes a high pressure fuel inlet 17 which is defined by a transversely extending port approximately in the mid-region of the nozzle holder body 5. The high pressure fuel inlet is conically re-entrant in shape to receive an inlet of the so-called "lance" type which is clamped into this inlet. The fuel injector defines a conical seating surface which is shaped for engagement with a high pressure fuel supply connector, in use. An oblique drilling 49*a*, 49*b* extends from the inlet 17 into the nozzle holder body 5 and then angles downward in a direction to connect to the high pressure drilling 29 defined in the valve block 25.

It is noted that in the vicinity of the actuator arrangement 35 the drilling is at an angle to the longitudinal axis of the fuel injector 1. It can further be seen that the angle with respect to the longitudinal axis changes as the drilling 49*b* connects to the high pressure drilling 29 in the valve block 25. This change of direction of the drillings 49*b*/29 is necessary in order for the drillings to avoid components within the injector, especially the solenoid actuator. However, it is noted that this arrangement results in high stresses at the various intersections within the injector, this is increasingly so, in sympathy with increasing changes in angle at the intersection.

It is further noted that the second part of the drilling 49*b* is substantially vertical in the arrangement shown in FIG. 1. This is because in order to maximise the cross-section of the nozzle holder body available for the solenoid actuator (and hence its performance) in the region of the solenoid actuator, a near vertical drilling here (past the solenoid actuator) is the option that takes up least cross-sectional area in this region.

It is also noted that within the nozzle holder body 5 the drilling 49*a*/49*b* changes direction at intersection point X. Point X represents the intersection of two drillings (49*a*, 49*b*) into the body 5, the first of which (49*a*) is made from the inlet 17 and the second of which (49*b*) is made from the bottom face of the body 5 (i.e. from the face that abuts valve block 25.

It is noted that the presence of these two intersecting drillings raises a number of disadvantages. The formation of the drillings requires a high level of accuracy to ensure the two drillings actually intersect. Furthermore, the drillings which are formed leave sharp edges at the intersection A which needs to be smoothed (e.g. using a sand or grit impregnated putty). Finally, the presence of a change in direction at intersection point X results in stress raisers.

The cap nut 7 houses the injection nozzle 9, the distance piece 21 and the valve arrangement 31, 33 and engages the nozzle holder body 5 by means of a screw thread.

FIG. 2 shows an enlarged view of a known actuator arrangement 35 in which like numerals between FIGS. 1 and 2 have been used to denote like features.

It is noted that the magnetic core material 37 is surrounded by a coil 50. A coil-former or bobbin 52 supports the coil 50 and lies between the coil 50 and the core member 37. A pole piece 53 is provided with a bore 54 within which the coil 50, bobbin 52 and core member 37 are located. The pole piece, coil 50 and core member 37 together form the stator part of a "magnetic circuit" within the actuator arrangement 35.

The core member 37 and pole piece 53 are both constructed of a soft magnetic material namely iron and it is noted that the core member 37 forms the inner part of the magnetic circuit (since part of the member 37 is formed within the coil 50) and the pole piece 53 forms the outer part of the magnetic circuit (it is formed outside the coil 50).

The core member 37 is generally T-shaped in cross section along its longitudinal axis (which is parallel with the longitudinal axis of the fuel injector 1) and comprises a central axial portion 55 and a horizontal top portion 56 (the "top" of the "T"). The bobbin 52 and coil 50 surround the axial portion 55. It is noted that the top portion 56 is stepped in two places (57, 58) and the second stepped portion forms a shoulder 58 which is arranged to abut a top face 60 of the pole piece 53 when the actuator arrangement 35 is assembled.

It is noted that the arrangement depicted in FIG. 2 is not yet assembled as there is a gap between the second shoulder 58 and the top face 60.

The known assembly method of the actuator arrangement of FIG. 2 comprises the following steps:

i) moulding the bobbin 52;

ii) winding the wire coil 50 onto the bobbin 52. It is noted that the bobbin 52 needs to be strong enough to survive the winding, handling and production processes. This therefore necessitates a relatively thick insulating wall of the order of 0.35 mm. Additionally, there will need to be some clearance between the bobbin 52 and the axial portion 55 of the inner core member 37.

iii) introduce the wound bobbin 52 over the axial portion 55 of the inner core member 37;

iv) introduce the inner core member 37, bobbin 52 and coil 50 into the bore of the pole piece 53 until the shoulder 58 abuts the top face 60 of the pole piece 53. It is noted that the stepped portion 57 of the core member 37 is of complementary shape to the bore 54 of the pole piece 53.

Correct assembly of the actuator arrangement requires the various components of the arrangement to be constructed to within specific tolerances. Known problems with the above arrangement and assembly method as a result of unfavourable tolerance build-ups are the failure of the bobbin 52 to form a seal with the lower portion 62 of the pole piece 53, thereby letting encapsulant past this point, and the crushing of the bobbin 52 as it is inserted into the bore 54. The coil also needs to be sealed away from the inner face of the pole piece 53.

It is noted that there is pressure on manufacturers, for example from a need to meet emissions regulations, to make engines which are smaller, lighter and more economical.

In sympathy, there is also pressure on Fuel Injection Equipment (FIE) manufacturers to make FIE engines which are smaller, lighter and more economical, including injectors of smaller diameters.

It is therefore an object of the present invention to provide an actuator arrangement that overcomes or substantially mitigates the above problems.

STATEMENTS OF INVENTION

According to a first aspect of the present invention there is provided an actuator arrangement for an electromagnetically operated fuel injector, the arrangement comprising: a generally cylindrical actuator core having a longitudinal axis (A) and defining, at an end thereof, an inner pole face of the actuator arrangement, the actuator core being formed of a bespoke magnetic material; a wire coil disposed around the actuator core and arranged to be connected to a power source in use so as to generate a magnetic field around the coil; a pole member formed of a high strength material and defining an aperture for receiving the actuator core, the pole member defining an outer pole face of the actuator arrangement, the outer and inner pole faces being substantially co-planar; and an armature movable in a direction parallel to the longitudinal axis (A) in response to the magnetic field in use of the actuator arrangement wherein, in use of the actuator arrangement, the magnetic field passes (i) into the armature in the region of the inner pole face and (ii) into the armature in the region of the outer pole face.

It is noted that in the present invention bespoke magnetic material does not form a closed loop around the coil. Instead the magnetic circuit that forms around the coil in use passes through bespoke magnetic material (the actuator core), which is chosen for its magnetic properties, and through bespoke structural components (e.g. the pole member), which are formed from material that is chosen for its structural capabilities. This is in contrast to prior art arrangements in which part of the pole piece/member (or an insert in the pole piece as per the example of FIG. 2) would be formed from magnetic material. It is noted that the actuator core is also referred to herein as the core member or actuator core member.

As a consequence of forming the pole member from a high strength material it is noted that the structural strength of the pole member is increased compared to prior art arrangements. The removal of the insert means compared to known systems means that in use the actuator core (rather than the insert) will abut the inner surface of the aperture in the pole member. As noted below this configuration allows the correct insertion of the core into the pole member (during assembly) to be easily detected.

It is noted that the actuator arrangement of the present invention provides for a double pole configuration. Such a configuration has advantages in injectors where armature travel is low. Preferably, in the gap between the armature and inner/outer pole faces the lines of magnetic flux are substantially parallel to the longitudinal axis.

Conveniently, the pole member may comprise a non-magnetic material having a relatively low magnetic permeability. The actuator core may also comprise a soft magnetic material having a relatively high magnetic permeability. The magnetic material may be relatively soft material compared to the high strength material. The pole member may comprise part of a magnetic circuit, the remaining part of the stator magnetic circuit being formed by the actuator core.

Preferably the aperture in the pole member defines a foot feature in a region close to the outer pole face. This feature may advantageously be used to help locate the actuator core when it is inserted into the aperture of the pole member during assembly. In a preferred arrangement the actuator core comprises a bobbin having a lip seal and the foot feature comprises a mating sealing surface for engagement with the lip seal. Conveniently, the lip seal and sealing surface may be arranged such that the insertion of the core into the aperture is halted when the lip seal abuts the mating sealing surface (correct insertion to predetermined point).

The sealing of the lip seal and sealing surface may conveniently be detected by a detection meas. Preferably, the detection means is arranged to monitor the pressure of air flowing between the lip seal and the mating sealing surface such that the correct insertion of the core into the aperture can be detected when the pressure of air flow is reduced.

The pole member may conveniently comprise a drilling that forms part of a high pressure line between a source of high pressure fuel and a nozzle region of the fuel injector. Preferably the drilling is substantially parallel to a longitudinal axis (A) of the fuel injector in use.

The actuator arrangement may further comprise a coil-former formed on the actuator core such that the coil is arranged to be insulated from the core by the coil-former.

A region of the actuator core may conveniently be arranged to be of complementary shape to the aperture and dimensioned such that it is retained within the aperture by means of an interference press fit. The complementary shaped region of the actuator core may comprise an upper region of the actuator core such that the coil is wound around a lower region of the actuator core. Conveniently, a coil-former may be carried by the lower region, the coil-former being arranged to carry the coil and to insulate the core from the coil. In the above arrangement the upper region of the actuator core may be of greater diameter than the lower region and coil.

The actuator arrangement may further comprise an insulating member carried on the actuator core and first and second electrical contact members received within the insulating member, the first and second electrical contact members being respectively connected to the first and second ends of the coil. A second insulating member may conveniently be carried on the first insulating member and envelop the first and second contact members such that contact faces defined by the contact members are substantially flush with an upper surface of the second insulating member The bespoke magnetic material may be a relatively soft material compared to the high strength material.

According to a second aspect of the present invention there is provided a method of assembling an actuator arrangement comprising a pole member defining an aperture and an actuator core that is received within the aperture, the method comprising: forming the actuator core to have a region that is complementary in shape to the aperture; dimensioning the complementary region such that it may be retained within the aperture by means of an interference press fit; introducing the actuator core into the aperture.

The actuator arrangement may conveniently be the actuator arrangement according to the first aspect of the present invention. Conveniently, the introducing of the actuator core into the aperture may be halted at a predetermined point. The predetermined point may be where a top pole face of the actuator core is flush with a top face of the pole member.

Conveniently the actuator core comprises a bobbin having a lip seal and the pole member comprises a mating sealing surface and the predetermined point occurs when the lip seal seals against the mating sealing surface.

Preferably, the method according to the second aspect of the present invention further comprises a detection step for detecting when the actuator core has reached the predetermined point. The detection step may conveniently comprise monitoring the pressure of air flowing between the lip seal and the mating sealing surface and determining that the predetermined point has been reached when the pressure of the air flow has altered.

According to a third aspect of the present invention there is provided a fuel injector comprising: a nozzle holder body; a fuel inlet; a high pressure fuel drilling and; an actuator arrangement according to the first aspect of the present invention wherein the actuator arrangement comprises a substantially vertical drilling arranged in use to convey fuel received from the high pressure drilling to a nozzle arrangement, the high pressure drilling comprising a single straight drilling having the fuel inlet at a first end and a connection to the vertical drilling at a second end.

The fuel inlet may preferably be a lance input point.

According to a fourth aspect of the present invention there is provided a method of forming a coil for an actuator arrangement for use in an electromagnetically operated fuel injector, the method comprising the steps of: i) providing a core member; ii) introducing the core member into a mould, a gap being provided between the core member and an inner surface of the mould and being dimensioned to the desired shape of a coil-former; iii) injection moulding the coil-former onto the core member; iv) removing the mould; v) winding the coil onto the coil-former.

The core member may be formed from a soft magnetic material.

According to a fifth aspect of the present invention there is provided an actuator arrangement for an electromagnetically operated fuel injector, comprising: a pole member defining an aperture; an actuator core that is received within the aperture and around which is wound a wire coil having first and second ends, the first and second ends arranged to be connected to a power source in use; and a coil-former injection moulded on the actuator core and wherein the coil is arranged to be insulated from the core by the coil-former.

BRIEF DESCRIPTION OF DRAWINGS

In order that the invention may be more readily understood, reference will now be made, by way of example, to the accompanying drawings in which:

Referring to FIGS. 3 to 7, an actuator arrangement 100 in accordance with the present invention is shown which comprises two main components: an actuator core member 102 (also referred to herein as the "actuator core" or "core member") and a generally cylindrical outer pole member or "pole piece" 104.

Figure 1:
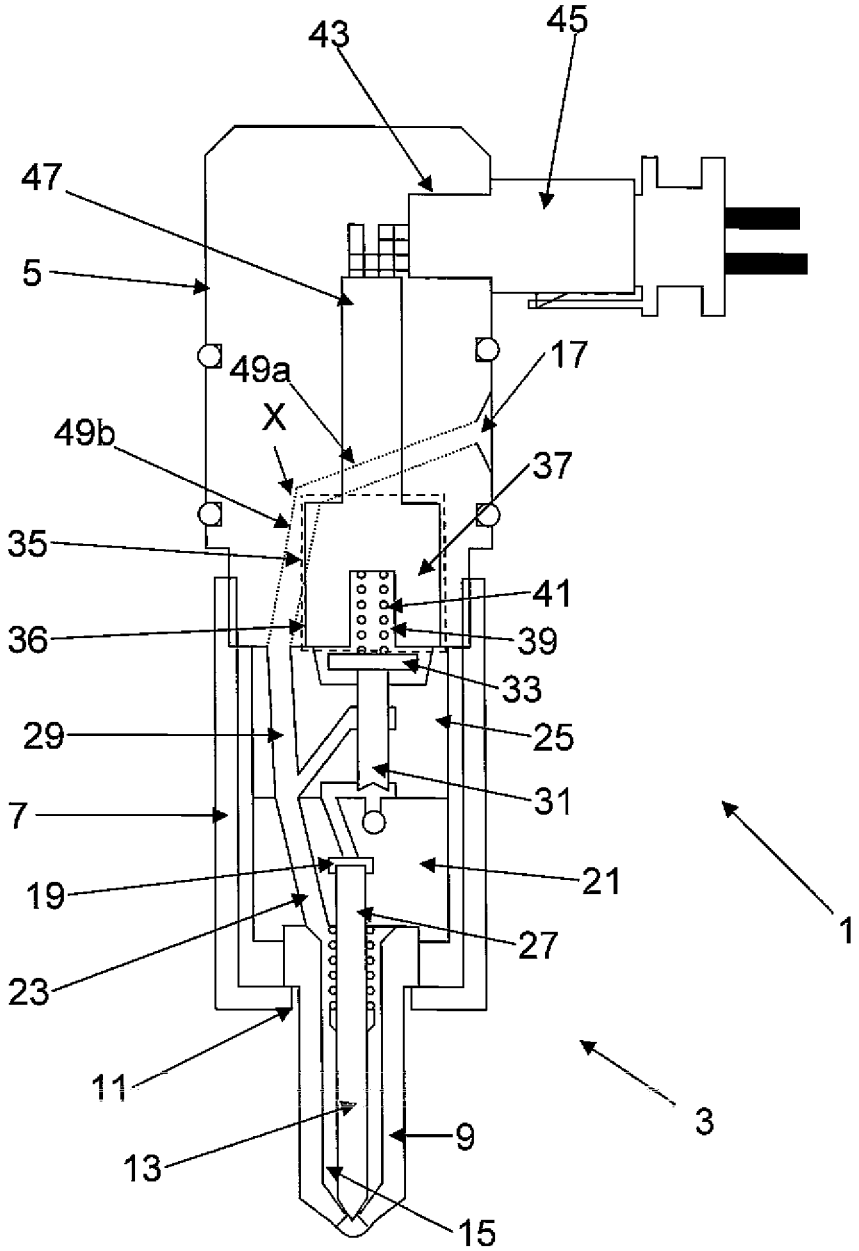
FIG. 1 shows a known fuel injector in schematic form.

The pole piece 104 comprises a large aperture 106 which is offset from the central longitudinal axis of the pole piece and within which the core member is located. The pole piece also comprises a drilling 108 which carries high pressure fuel in use from a fuel inlet (not shown in FIG. 3, feature 17 in FIG. 1) to an injection nozzle (not shown in FIG. 3, feature 9 in FIG. 1).

It is noted that the since the aperture 106 is offset from the longitudinal axis, the pole piece 104 is provided with a wall of varying thickness.

The core member 102 comprises an upper region 110 and a lower region 112 of smaller diameter than the upper region 110. A C-shaped cross-section coil-former 114 is carried on the lower region 112 and a coil 116 (or solenoid) is wound over the coil-former such that part of the lower region of the core member 102 is located within the volume defined by the coil 116. It is appreciated that the precise number of coils in the solenoid 116 is predetermined in order to provide the actuator arrangement 100 with suitable operating characteristics. However, the number of coils is not central to the present invention and will not be discussed in detail here.

The lower region 112 of core member 102 defines a blind bore 118 which is dimensioned to receive the spring 41 (shown in FIG. 1) of the valve member 31 (shown in FIG. 1). The presence of the blind bore 118 in core member 102 provides the lower region 112 with a ring like end face.

An insulator disc 120 is provided on top of the core member 102 such that the core member 102 abuts the lower face of the insulator disc. Electrical contacts 122, 124 are provided within the upper face of the insulator disc for electrical connection to the electrical connector 45 (shown in FIG. 1).

Figure 5:
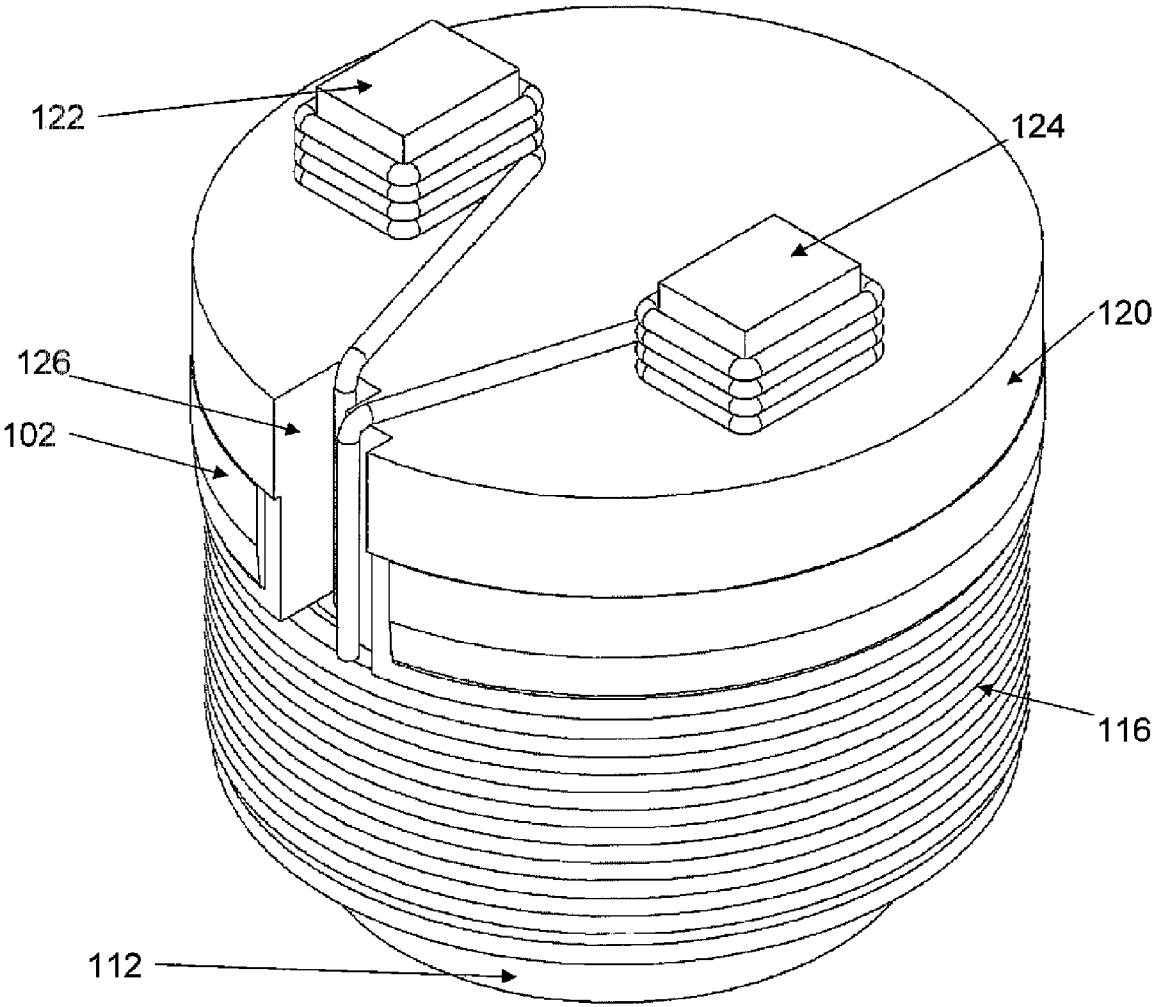

The ends of the coil pass up a channel 126 (see FIG. 5) in the side of the core member 102 and insulator disc 120 such that one end is wound around contact 122 and the other end is wound around contact 124.

It is noted that the top faces of the contacts 122, 124 are flush with the top face of the pole piece 104 and the core member 102, coil 116, coil-former 114, insulating disc 120 and contact 122, 124 are located entirely within the aperture 106 of the pole piece 104. In contrast to the actuator arrangement of FIG. 2 it is noted that the actuator arrangement according to an embodiment of the present invention does not comprise the two stepped arrangement and in particular does not comprise the shoulder feature 58.

It is noted that the coil-former 114 forms an insulating barrier between the core member 102 and the coil 116. It is further noted that the coil-former is connected to the insulating disc 120 by virtue of the presence of insulating material in the channel 126.

The pole piece 104 is made of a high strength material such as hardened steel. In other words the pole piece 104 is a bespoke structural component (i.e. a material chosen for its structural properties). The outer pole piece 104 may, for example, be made from a (medium carbon) steel which is capable of being treated by a through or case hardening technique. It is noted that the steel for the pole piece block may be in the range 0.1-0.4% carbon steel and may have an ultimate tensile strength (UTS) of approximately 1000 MPa.

The core member 102 is made of a bespoke magnetic material (i.e. a material chosen primarily for its magnetic properties as opposed to structural properties) which is relatively soft compared to the material of the pole piece 104. Suitable magnetic materials for the core member 102 may comprise: very low carbon iron, silicon-iron, alloys of iron with variously Manganese, Cobalt or Nickel, or non-ferrous magnetic materials such as TiCoNAl or AlNiCo.

In the present example, the core member 102 is constructed from very low carbon iron (less than 0.05% carbon) with between 2.25-3% silicon content. It is noted that the presence of silicon within the core material helps reduce undesirable "eddy currents". If the silicon content rises into the range of 3-4% then it becomes increasingly difficult to machine and at around 4% the material may be used in sintered form. It is also noted that above approximately 3% silicon the magnetic flux density becomes reduced.

The core member 102 may have a UTS value of the order of 200 MPa. This is considerably "softer" than the pole piece 104. It is also noted that the valve block 25, which may be case hardened steel, would typically have a UTS value of approximately 2000 MPa.

It is therefore noted that bespoke magnetic material does not form a closed loop around the coil 116. Instead the magnetic circuit that forms around the coil 116 in use passes through bespoke magnetic material (the core member 102), which is chosen for its magnetic properties, and through bespoke structural components (e.g. the pole piece 104), which are formed from material that is chosen for its structural capabilities This is in contrast to prior art arrangements in which part of the pole piece 104 (or an insert in the pole piece) would be formed from magnetic material.

As a consequence of forming the pole piece 104 from a high strength material it is noted that the outer part of the magnetic circuit is no longer formed from a bespoke magnetic material. The absence of the relatively soft magnetic material in the outer part of the circuit means that the structural strength of the pole piece 104 is increased compared to prior art arrangements. This, in turn, means that the drilling 108 can be made vertically (i.e. parallel to the longitudinal axis of the fuel injector 1) through the pole piece 104. Since the actuator arrangement 100 is now a separate block, including the vertical drilling 108, changes in direction of the high pressure drilling within the nozzle body holder 5 can be eliminated (as described in relation to FIG. 6 below) which in turn reduces the stresses experienced within the injector considerably (up to a factor of 2 or 3 times reduction). Alternatively, changes in angle at the intersection of the high pressure drilling can be considerably reduced, either when the inlet is from the side of the nozzle holder body, as with a "lance" inlet, or from the top of the nozzle holder body, as with an axial inlet.

It is also noted that by removing the bespoke magnetic material from the pole piece 104 the amount of bespoke magnetic material is reduced compared to prior art arrangements. This represents a cost saving since the bespoke magnetic material is expensive to source and machine.

Although the outer part of the magnetic circuit in the arrangement of FIGS. 3 to 7 is not formed from the traditional (or bespoke) magnetic material, it is noted that the outer part of the circuit is not normally saturated in use and so the change of material to the high strength hardened steel only represents a small, tolerable, reduction in efficiency.

Figure 2:
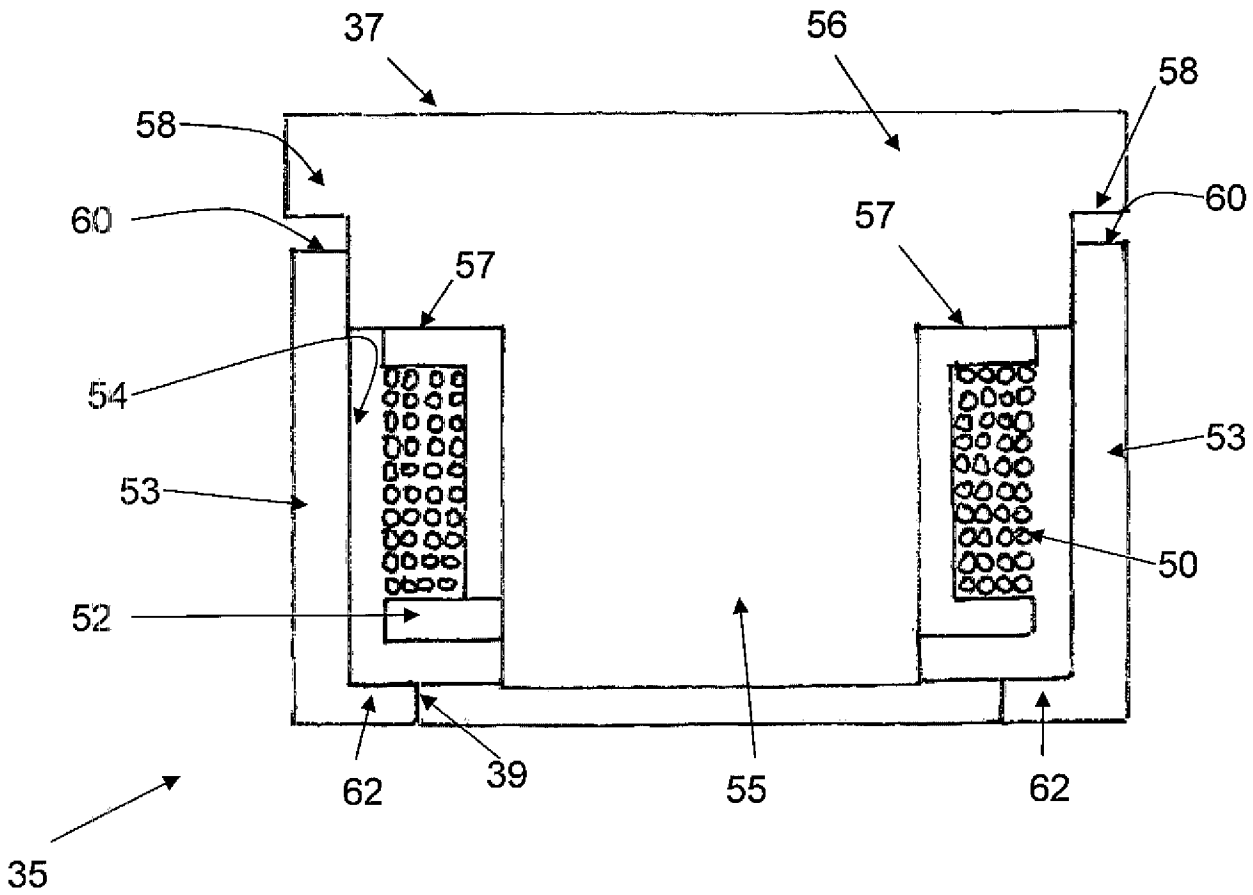
FIG. 2 shows an enlarged section of the known fuel injector of FIG. 1.
Figure 3:
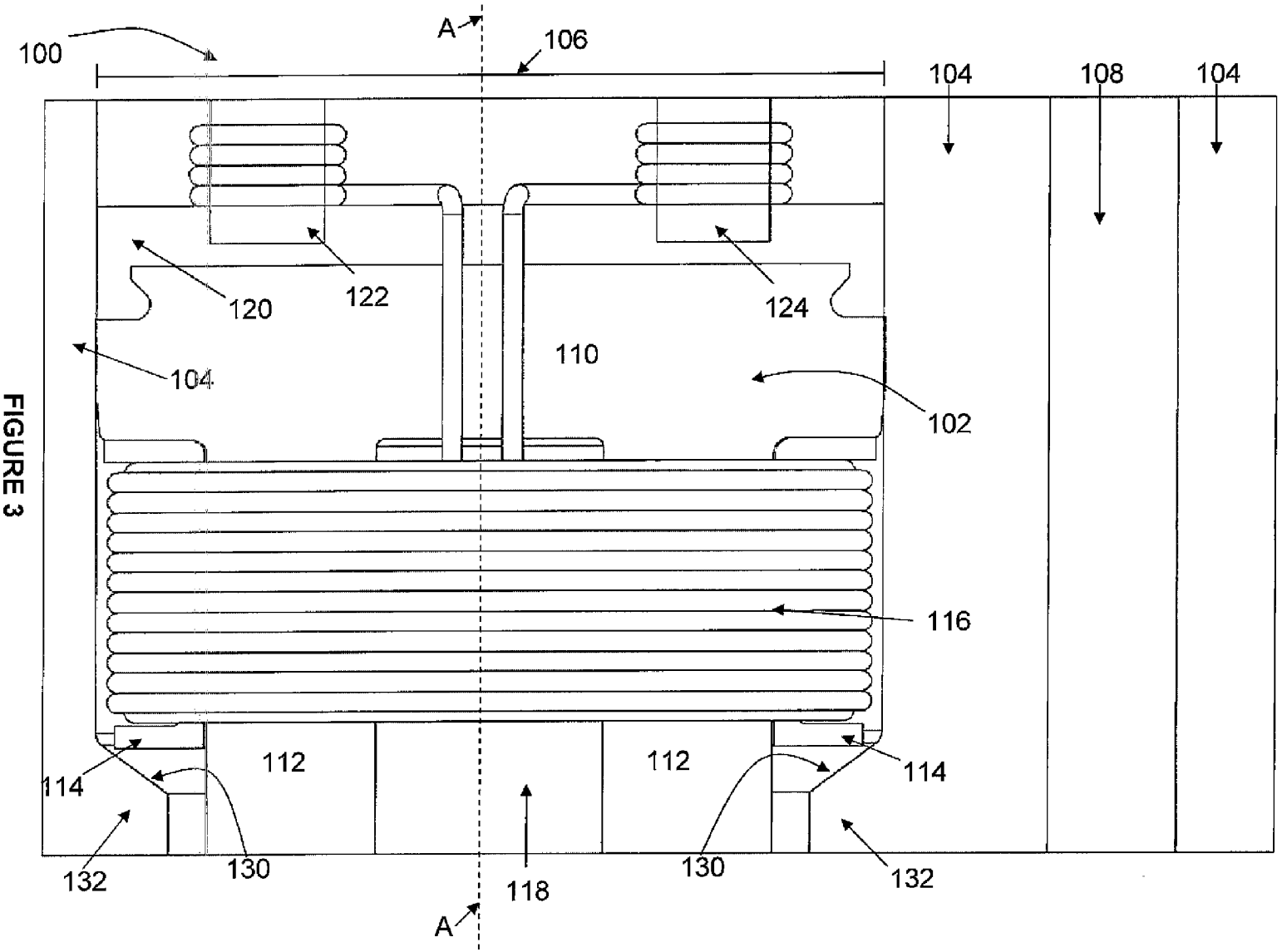
FIG. 3 shows a section through an actuator arrangement in accordance with an embodiment of the present invention.
Figure 4:
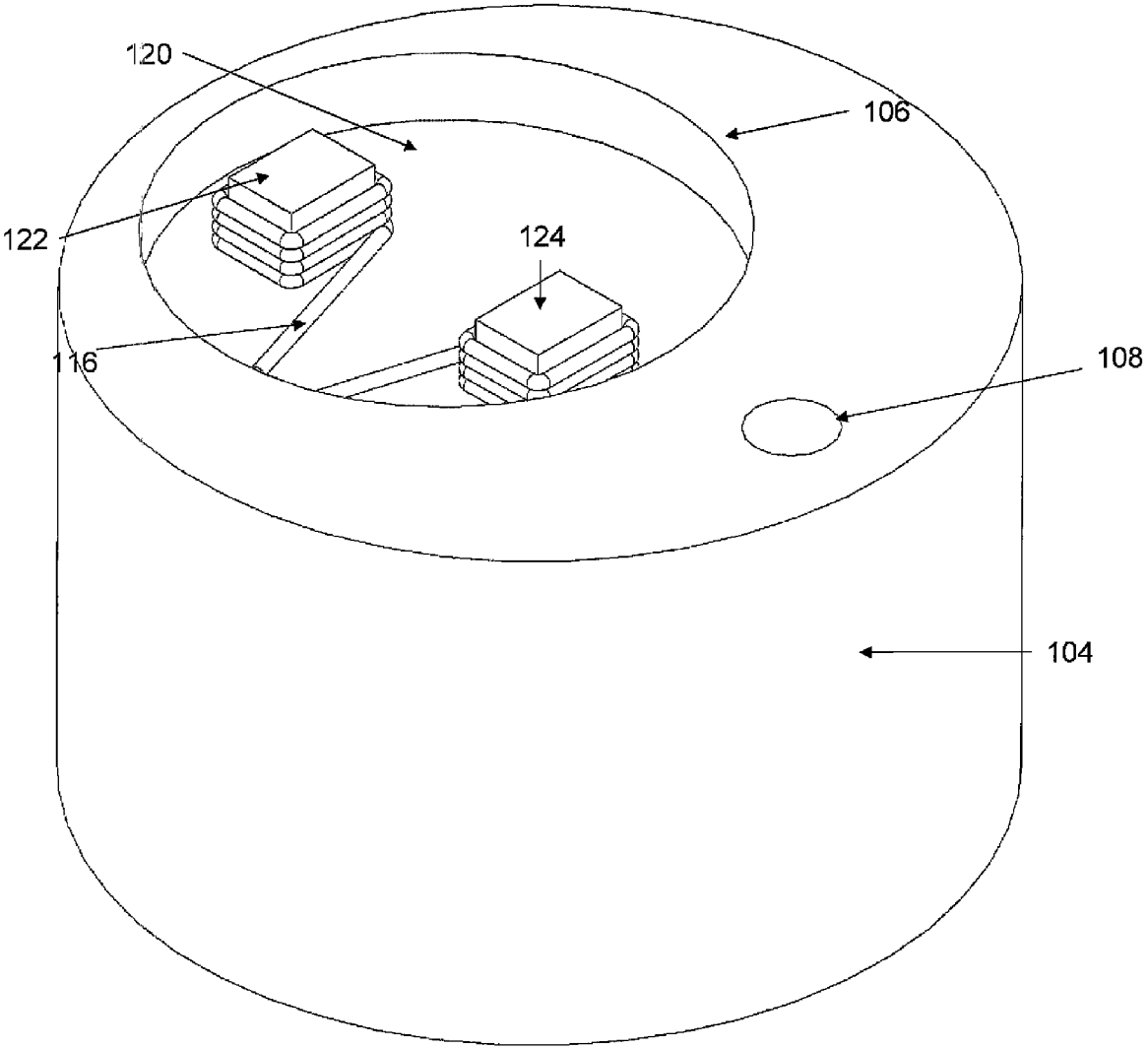
FIGS. 4 and 5 show perspective views of the arrangement of FIG. 3.

The method of winding the coil on the coil-former for the actuator arrangement of FIG. 3 (and also shown in FIG. 4) differs from the known method (as detailed above in relation to FIG. 2) and comprises the following steps:

i) providing the core member 102;

ii) introducing the core member 102 into a mould, a gap being provided between the core member 102 and the inner surface of the mould which is dimensioned to the required shape of the coil-former 114 (and also the required shape of the disc 120);

iii) injection moulding the coil-former 114 on the core member 102;

iv) removing the mould and winding the coil 116 onto the coil-former 114.

By forming the coil-former 114 on the core member 102 the coil-former can be made thinner than prior art coil-formers 52 (of the order of 0.2 mm instead of 0.35 mm). This is because the coil-former 116 does not have to support the winding process in isolation (as is the case for the coil-former 52 described in relation to FIG. 2) and is in fact already formed on the core member 102 before the coil winding process begins. The core member 102 therefore provides the structural stability required to support the winding process and survive the handling and production processes, and the coil-former 114 may therefore be thinner than in known systems. Additionally, since the coil-former 114 is moulded directly on the core member 102, there is no requirement for clearance between these two, enabling a yet more compact arrangement.

The method of assembling the actuator arrangement of FIGS. 3 to 7 also differs from the known assembly method. As noted above, the core member 102, coil 116, coil-former 114, insulating disc 120 and contacts 122, 124 (the "core components") are located entirely within the aperture 106 of the pole piece 104. There is no equivalent feature to the shoulder 58 feature of FIG. 2.

The core components may therefore be inserted into the aperture 106 of the pole piece 104 and held in place by means of an interference press fit up to a pre-determined point such as either: when the lower region of core member 102 is level with the bottom of the pole piece 104; or, when a satisfactory seal is detected between the lip at the bottom of coil-former 114 and a seating surface 130 on a foot feature 132 at one end of the pole member 104, e.g. by monitoring air past this seal during insertion and responding to the point at which the seal is made by halting the insertion movement. The reduction in thickness of the coil-former 116 means that the solenoid may be a more compact design, thereby improving magnetic performance and removing heat generated in the coil more efficiently. The interference fit insertion up to a predetermined point enables the tolerance build-up issues noted above to be reduced so that there is a reduced risk of crushing the coil former, whilst also providing a satisfactory seal between the lip at the bottom of coil-former 114 and the seating surface 130.

The "shoulderless" arrangement of the actuator arrangement 100 of FIGS. 3 to 7 helps reduce the tolerance stack-up within injector and allows the actuator arrangement to be positioned either by bringing the core member 102 to rest.

Figure 6:
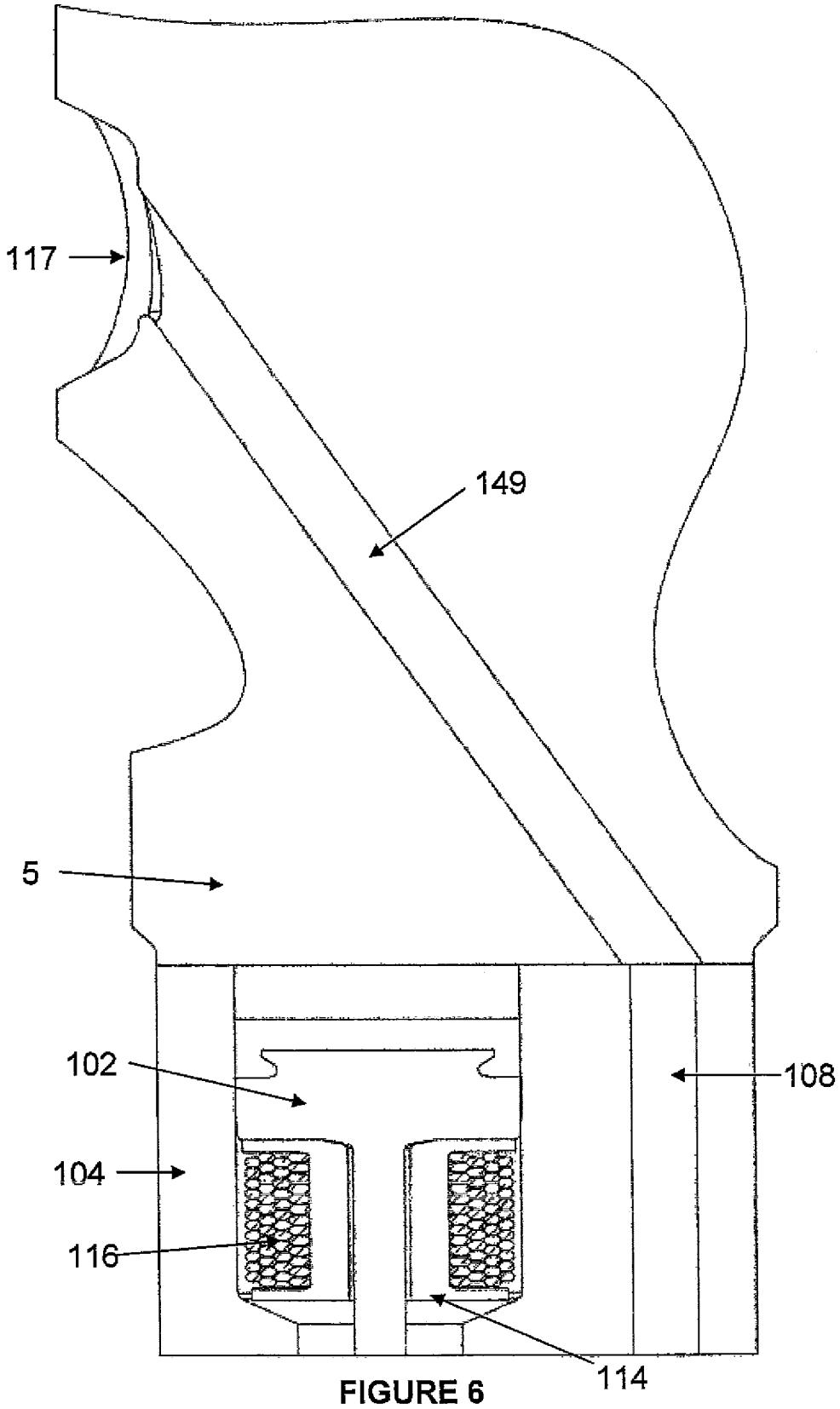
FIG. 6 shows a section through the actuator arrangement of FIG. 3 and the nozzle holder body of a fuel injector.

The reduction in the amount of bespoke magnetic material that is used in the actuator arrangement and the reduction in size of the coil-former 114 results in a smaller actuator arrangement 100 compared to known actuator arrangements 35. As a consequence of the reduced size of the actuator block it is possible to locate the actuator arrangement 100 within the pole piece 104 such that a straight drilling 149 (see FIG. 6) can be made from a fuel inlet 117 to the vertical drilling 108 in the pole piece 104. This arrangement is depicted in FIG. 6 where an oblique drilling is formed without the kinks or intersections found in the prior art (see intersection X in FIG. 1). The drilling 149 is therefore easier to form as there is no need to match two separate drillings together (49*a*, 49*b*) and furthermore there are no sharp edges formed at the intersection that require smoothing. In use, the arrangement of FIG. 6 also offers a fuel injector arrangement which does not suffer from the stress raisers found in the arrangement of FIG. 2.

The drilling 148 and nozzle body 5 arrangement of FIG. 6 is partially made possible by the fact that the input 117 is a conical lance input for connection to a "lance-type" fuel supply means. In a lance arrangement a relatively long lance structure is brought into communication with the input 117 through a drilling in the engine block. This lance is rigid and is biased into communication with the input 117 to form a fluid tight seal. It is noted that such a lance arrangement is less bulky at the point it connects to the nozzle holder body 5 compared to a high pressure fuel pipe and high pressure fuel connector.

In FIG. 2 the relatively large size of the actuator arrangement 35 compared to the actuator arrangement that is the subject of the present invention means that it is not possible to provide a single oblique drilling from the input 17 to the valve block 25 because the lance connection would have to be located too far up the nozzle holder body 5 to achieve the required angle.

Figure 7:
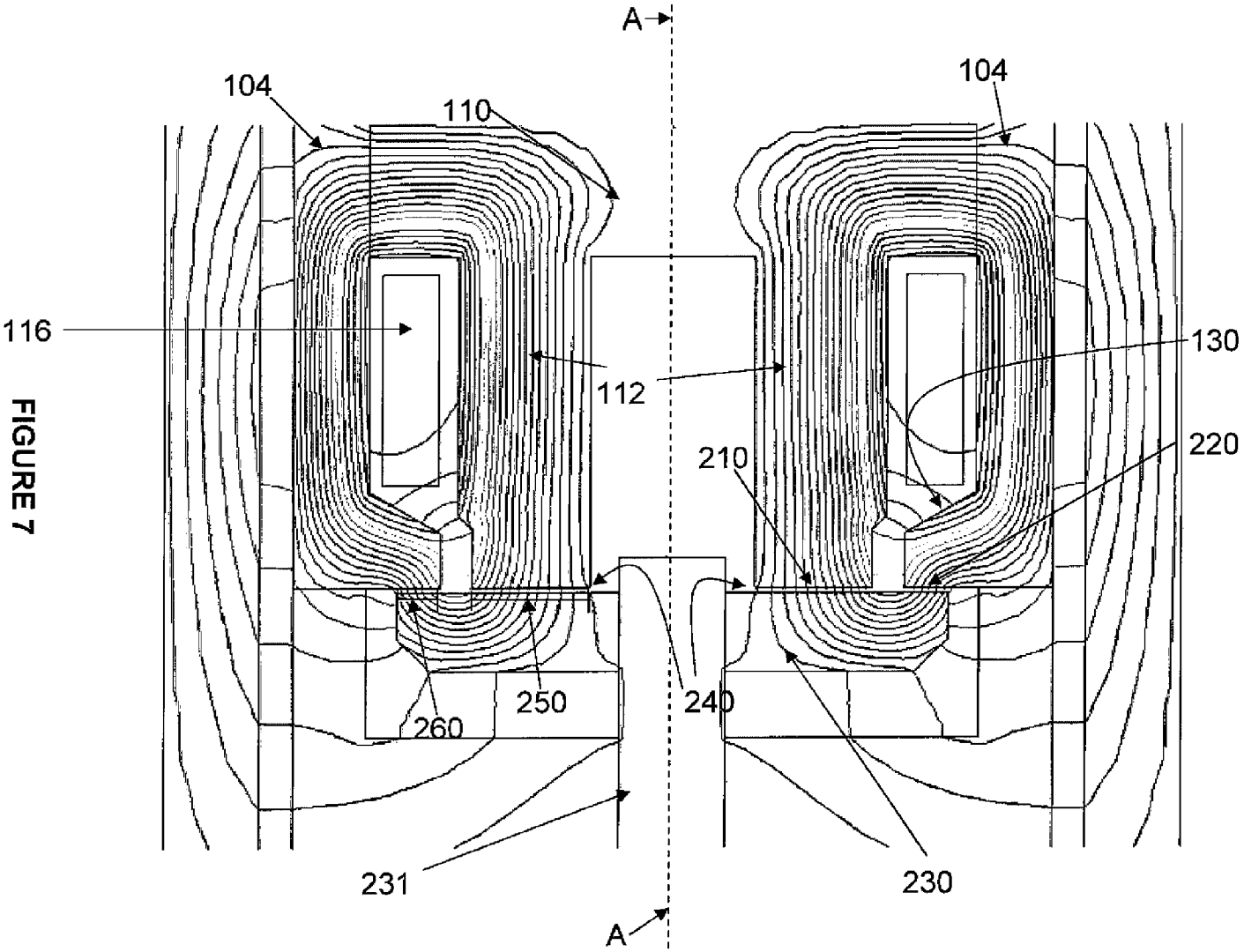
FIG. 7 shows a representation of an actuator arrangement in accordance with an embodiment of the present invention in which the magnetic flux lines are visible.

FIG. 7 shows a similar view of the actuator arrangement according to an embodiment of the present invention as FIG. 3 and like numerals are used to denote like features. FIG. 7 additionally shows that the actuator core 112 defines at an end therefore an inner pole face 210. It can also be seen that the pole member 104 defines an outer pole face 220 and that the inner and outer pole faces are substantially co-planar.

The armature 230 of the fuel injector is also depicted in FIG. 7 and it can be seen that there is a small gap 240 between the inner pole face 210 of the actuator arrangement and the armature 230 and between the outer pole face 220 and the armature 230.

The magnetic flux lines within the actuator arrangement are shown in FIG. 7 and it can be seen that within the gap 240 the flux is substantially parallel to the longitudinal axis A. Once the flux lines enters the material of the core and pole member it can be seen to follow a curved path. It can be seen that the actuator arrangement comprises a double pole configuration (250, 260). The valve member 231 is also shown.

It will be understood that the embodiments described above are given by way of example only and are not intended to limit the invention, the scope of which is defined in the appended claims. It will also be understood that the embodiments described may be used individually or in combination.

It is noted that an axial fuel inlet located at the top of the nozzle holder body may be used instead of a lance type inlet.

The invention claimed is:

1. An actuator arrangement for an electromagnetically operated fuel injector, the arrangement comprising:

a generally cylindrical actuator core having a longitudinal axis and defining, at an end thereof, an inner pole face of the actuator arrangement, the actuator core being formed of a bespoke magnetic material having a relatively high magnetic permeability;

a wire coil disposed around the actuator core and arranged to be connected to a power source in use so as to generate a magnetic field around the coil;

a pole member formed of a high strength material having a relatively low magnetic permeability and defining an aperture for receiving the actuator core, the pole member defining an outer pole face of the actuator arrangement, the outer and inner pole faces being substantially co-planar; and an armature moveable in a direction parallel to the longitudinal axis in response to the magnetic field in use of the actuator arrangement wherein, in use of the actuator arrangement, the magnetic field passes (i) into the armature in the region of the inner pole face and (ii) into the armature in the region of the outer pole face.

2. An actuator arrangement as claimed in claim 1, wherein the magnetic field passes (i) between the armature and the inner pole face in a direction substantially parallel to the longitudinal axis and (ii) between the armature and the outer pole face in a direction substantially parallel to the longitudinal axis such that the actuator arrangement comprises a double pole configuration.

3. An actuator arrangement as claimed in claim 1, wherein the pole member comprises a non-magnetic material.

4. An actuator arrangement as claimed in claim 1, wherein the actuator core comprises a soft magnetic material.

5. An actuator arrangement as claimed in claim 1, wherein the aperture has a first region that is generally cylindrical and having a first radius and wherein a second region of the aperture proximal to the outer pole face has a second radius that is less than the first radius, such that a foot feature is defined at one end of the pole member.

6. An actuator arrangement as claimed in claim 5, wherein the actuator core comprises a bobbin and the foot feature of the pole member comprises a mating sealing surface such that the bobbin seals against the sealing surface.

7. An actuator arrangement as claimed in claim 6, wherein the bobbin and sealing surface are arranged such that introducing the core into the aperture is halted at a predetermined point.

8. An actuator arrangement as claimed in claim 1, wherein the pole member comprises a drilling that forms part of a high pressure line between a source of high pressure fuel and a nozzle region of the fuel injector.

9. An actuator arrangement as claimed in claim 8, wherein the drilling is substantially parallel to the longitudinal axis.

10. An actuator arrangement as claimed in claim 1, further comprising a coil-former formed on the actuator core and wherein the coil is arranged to be insulated from the core by the coil-former.

11. An actuator arrangement as claimed in claim 1, wherein a region of the actuator core is arranged to be of complementary shape to the aperture and dimensioned such that it is retained within the aperture by means of an interference press fit.

12. An actuator arrangement as claimed in claim 11, wherein the complementary shaped region of the actuator core comprises an upper region of the actuator core and the coil is wound around a lower region of the actuator core, wherein a coil-former is carried by the lower region, the coil-former being arranged to carry the coil and to insulate the core from the coil.

13. An actuator arrangement as claimed in claim 1, further comprising an insulating member carried on the actuator core and first and second electrical contact members received within the insulating member, the first and second electrical contact members being respectively connected to the first and second ends of the coil.

14. An actuator arrangement as claimed in claim 13, wherein a second insulating member is carried on the first insulating member and envelops the first and second contact members such that contact faces defined by the contact members are substantially flush with an upper surface of the second insulating member.

15. A method of assembling an actuator arrangement according to claim 1, the method comprising:

forming the actuator core to have a region that is complementary in shape to the aperture;

dimensioning the complementary region such that it may be retained within the aperture by means of an interference press fit; and introducing the actuator core into the aperture.

16. A method as claimed in claim 15, wherein the introducing of the actuator core into the aperture is halted at a predetermined point.

17. A method as claimed in claim 16, wherein the predetermined point is where a top pole face of the actuator core is flush with a top face of the pole member.

18. A method as claimed in claim 17, wherein the actuator core comprise a bobbin having a lip seal and the pole member comprises a mating sealing surface and the predetermined point occurs when the lip seal seals against the mating sealing surface.

19. A method as claimed in claim 18, further comprising a detection step for detecting when the actuator core has reached the predetermined point, wherein the detection step comprises monitoring the pressure of air flowing between the lip seal and the mating sealing surface and determining that the predetermined point has been reached when the pressure of air flow is reduced.

* * * * *